US009831047B2

(12) United States Patent
Carlson et al.

(10) Patent No.: US 9,831,047 B2
(45) Date of Patent: Nov. 28, 2017

(54) SWITCH WITH CIRCUMFERENTIAL INDICATOR LIGHT

(71) Applicant: Banner Engineering Corporation, Minneapolis, MN (US)

(72) Inventors: Michael Scott Carlson, Deephaven, MN (US); Darrell Raymond Pikkaraine, Elk River, MN (US)

(73) Assignee: BANNER ENGINEERING CORPORATION, Minneapolis, MN (US)

( * ) Notice: Subject to any disclaimer, the term of this patent is extended or adjusted under 35 U.S.C. 154(b) by 85 days.

(21) Appl. No.: 14/168,845

(22) Filed: Jan. 30, 2014

(65) Prior Publication Data

US 2014/0239162 A1 Aug. 28, 2014

Related U.S. Application Data

(60) Provisional application No. 61/849,655, filed on Jan. 30, 2013.

(51) Int. Cl.
*H01H 3/02* (2006.01)
*H01H 9/16* (2006.01)

(52) U.S. Cl.
CPC ..... *H01H 3/022* (2013.01); *H01H 9/161* (2013.01)

(58) Field of Classification Search
CPC ..... H01H 3/022; H01H 9/161
See application file for complete search history.

(56) References Cited

U.S. PATENT DOCUMENTS

| | | | | |
|---|---|---|---|---|
| 6,198,058 | B1 * | 3/2001 | Graninger | H01H 13/02 200/16 R |
| 7,205,495 | B2 * | 4/2007 | Mazur | H01H 19/025 200/316 |
| 8,242,397 | B2 * | 8/2012 | Fu | H01H 13/023 200/314 |
| 2002/0071279 | A1 * | 6/2002 | Katogi | H05B 33/0863 362/317 |
| 2010/0170276 | A1 * | 7/2010 | Kang | F24F 1/0007 62/259.1 |
| 2010/0243418 | A1 * | 9/2010 | Machida | H01H 3/022 200/341 |

* cited by examiner

*Primary Examiner* — Francis M Legasse, Jr.
(74) *Attorney, Agent, or Firm* — Merchant & Gould P.C.

(57) ABSTRACT

A switch is disclosed. In some examples, a switch includes a generally cylindrical housing; one or more sets of contact points enclosed by the housing; an indicator module, such as a multi-color LED illuminator, also enclosed by the housing; and a pushbutton actuator disposed to operate the contact points. The housing includes a display section spanning substantially the entire circumference of the housing such that the indication made by the indicator module is visible from all radial directions. When the pushbutton actuator is pressed, some of the contact points open to cut off power from hazards, while others are reconfigured to change the state of the indicator module to indicate the changed status of the switch. Multiple switches can be interfaced with each other, such as by serial connection, to facilitate multi-switch safety environment. Modular cables can be used to conveniently establish the interface.

24 Claims, 11 Drawing Sheets

SWITCH WITH CIRCUMFERENTIAL INDICATOR LIGHT

CROSS REFERENCE TO RELATED APPLICATIONS

This application claims the benefit of U.S. Provisional Application Ser. No. 61/849,655, filed Jan. 30, 2013. The U.S. Provisional Application Ser. No. 61/849,655 is incorporated herein by reference.

BACKGROUND

This disclosure relates generally to devices, such as an "emergency stop" device, which perform a machine function that is manually initiated during urgent situations that results in immediate or controlled cessation of machine motion or other hazardous situations.

In certain settings, quick, unobstructed access by personnel to emergency stop devices is required on all operator stations and other locations as determined by a risk assessment. Actuating an emergency stop device can remove all energy sources to hazards and overrides all other functions and operations in all modes.

An "emergency stop" device can take many forms, but typically is a pushbutton-operated device that is actuated by a single human action.

The present disclosure relates to pushbutton-operated emergency-stop device that is designed to facilitate high visibility, easy access and convenient safety system configuration.

SUMMARY

The present disclosure relates to a pushbutton-operated switch. In some configurations, a switch according to the present disclosure includes a generally cylindrical housing; one or more sets of contact points enclosed by the housing; an indicator module, such as a multi-color LED illuminator, also enclosed by the housing; and a pushbutton actuator disposed to operate the contact points. The housing includes a display section spanning substantially the entire circumference of the housing such that the indication made by the indicator module is visible from all radial directions. When the pushbutton actuator is pressed, some of the contact points open to cut off power from hazards, while others are reconfigured to change the state of the indicator module (e.g., change from yellow light to flashing red light) to indicate the changed status of the switch.

According to some aspects of the disclosure, multiple switches can be interfaced with each other, such as by serial connection, to facilitate multi-switch safety environment. Modular cables can be used to conveniently establish the interface.

DETAILED DESCRIPTION

Figure 1:
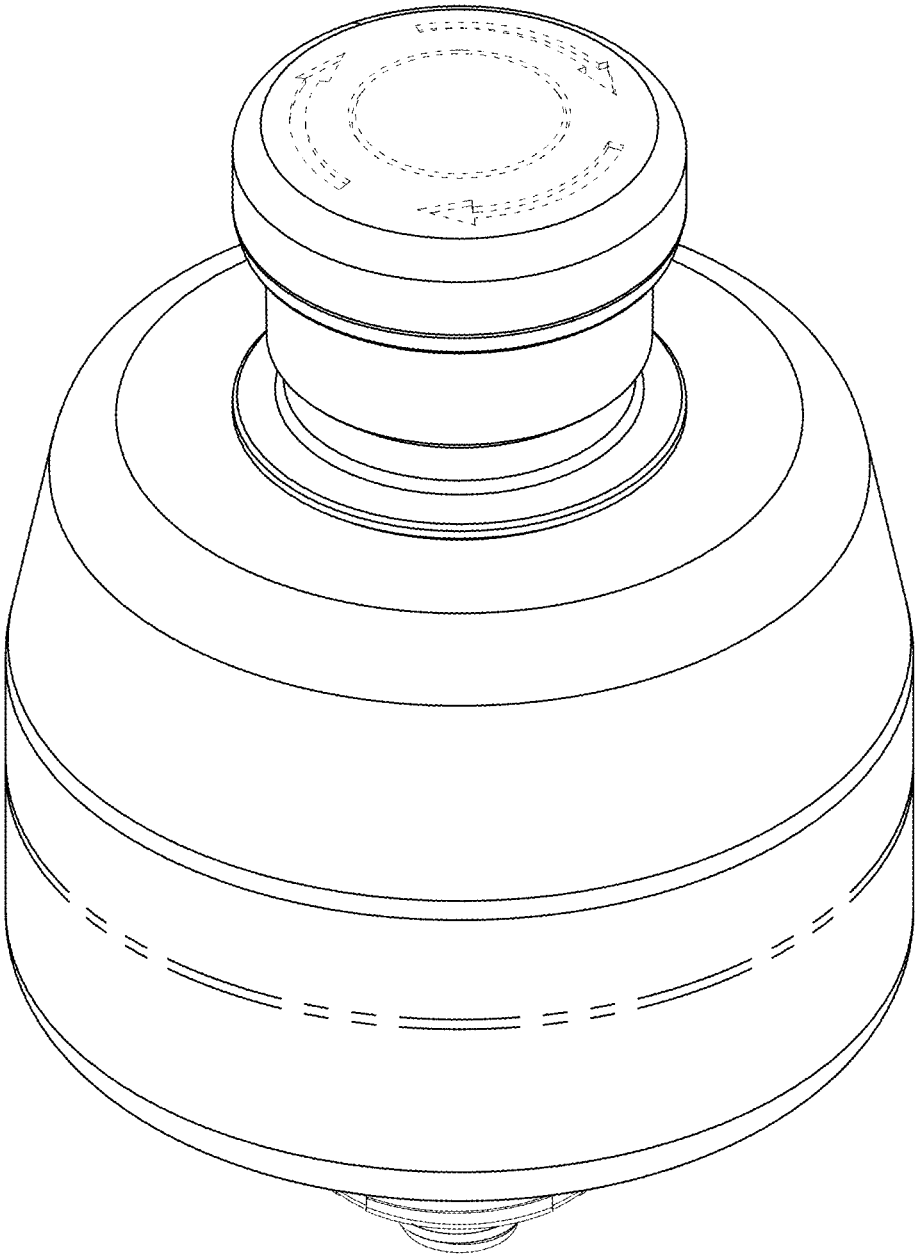
FIG. 1 shows a perspective view of a switch according to one aspect of the present disclosure.
Figure 2:
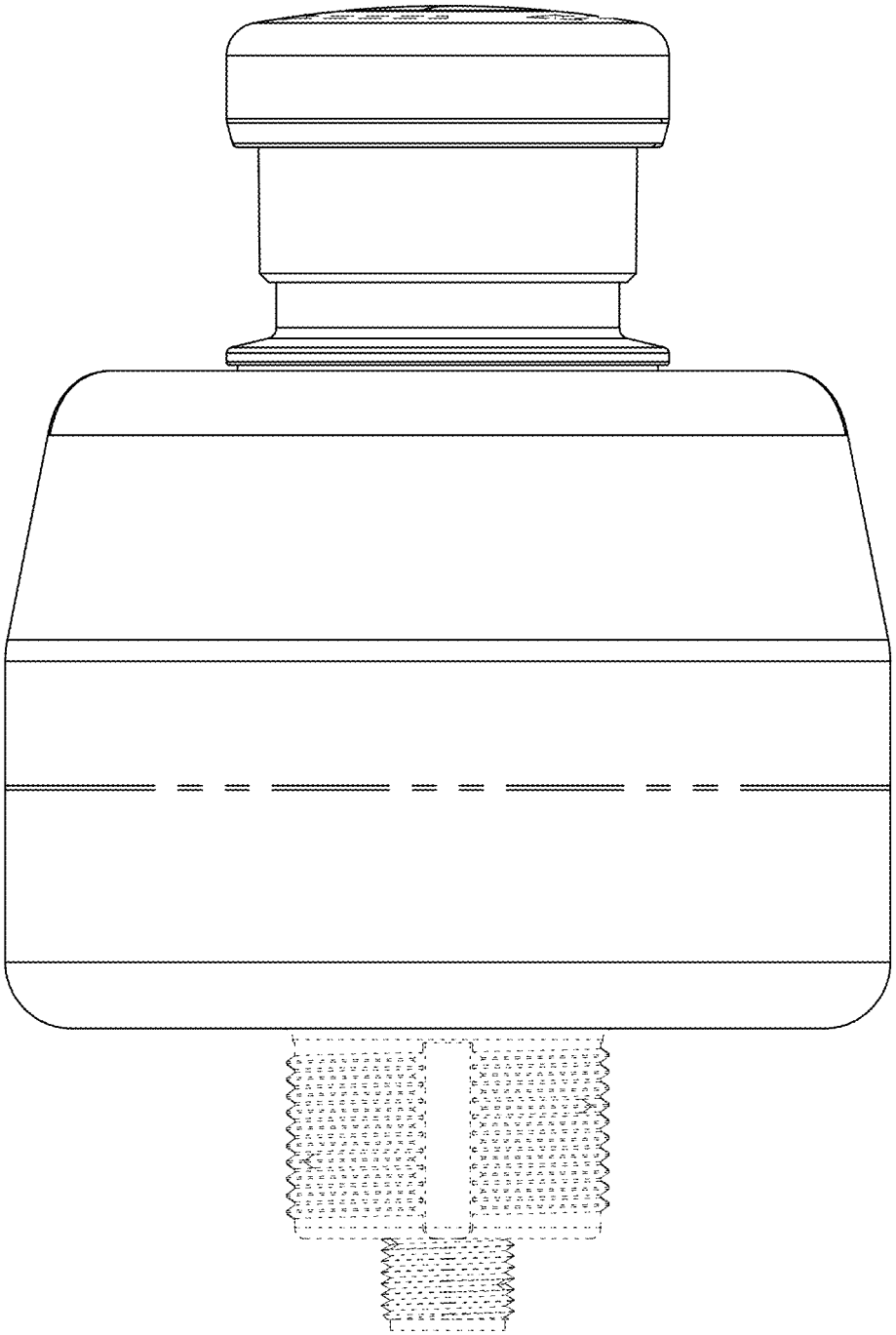
FIG. 2 shows a side view of the switch shown in FIG. 1.
Figure 3:
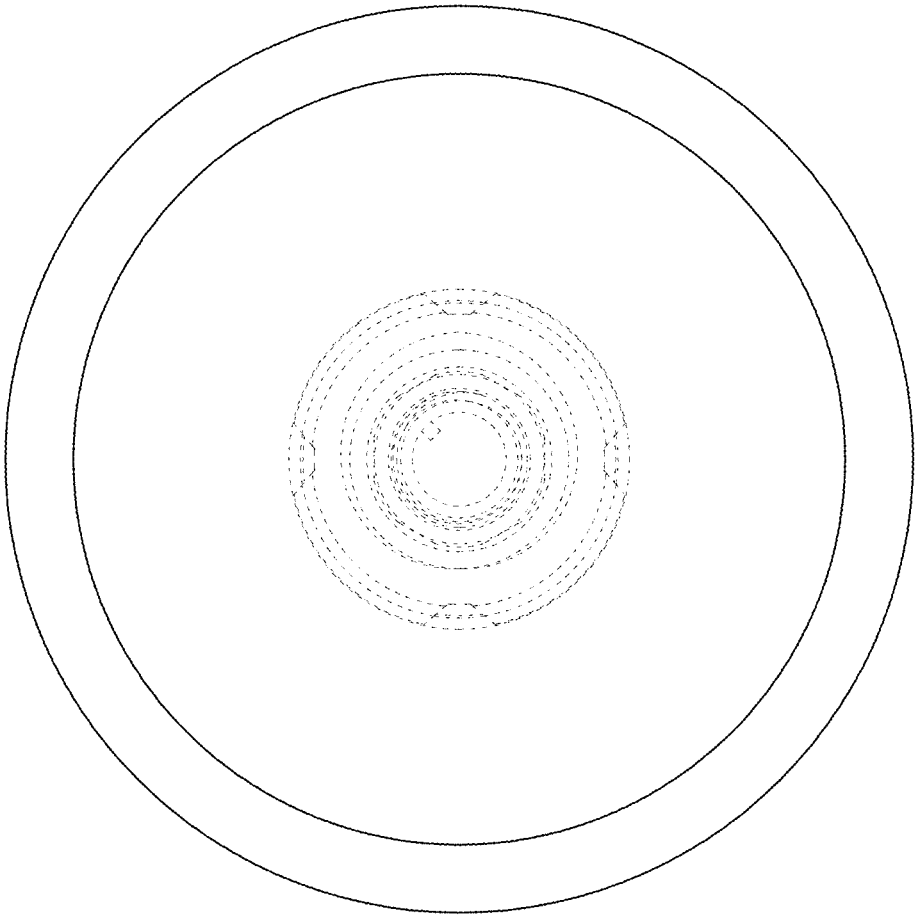
FIG. 3 shows a bottom view of the switch shown in FIG. 1.
Figure 4:
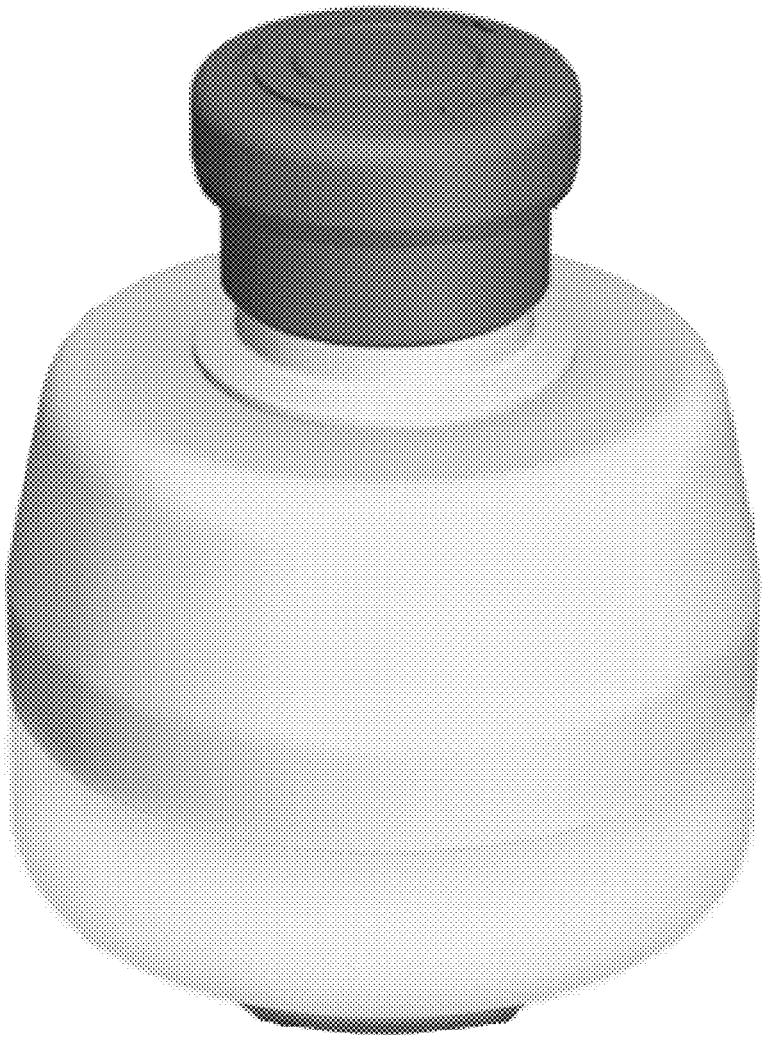
FIG. 4 illustrates a switch according to one aspect of the present disclosure with its illumination indicator indicating (e.g., by yellow light) that the switch is in its armed state.
Figure 5:
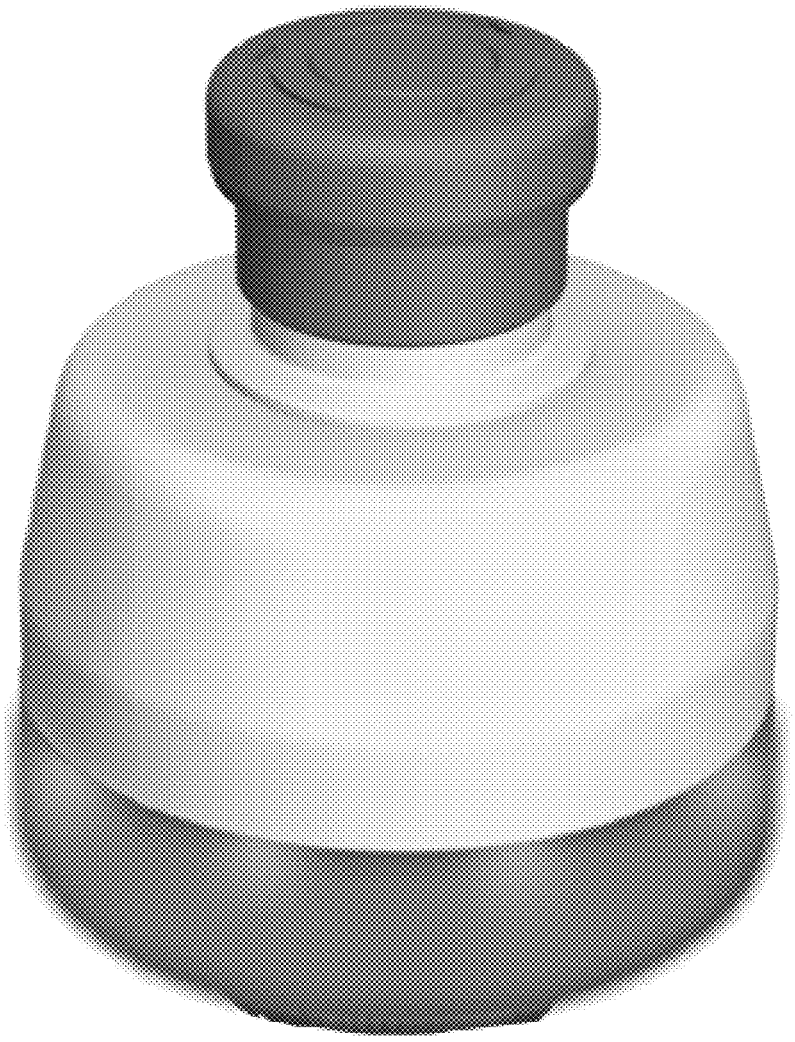
FIG. 5 illustrates a switch according to one aspect of the present disclosure with its illumination indicator indicating (e.g., by flashing red light) that the pushbutton of switch has been pressed.
Figure 6:
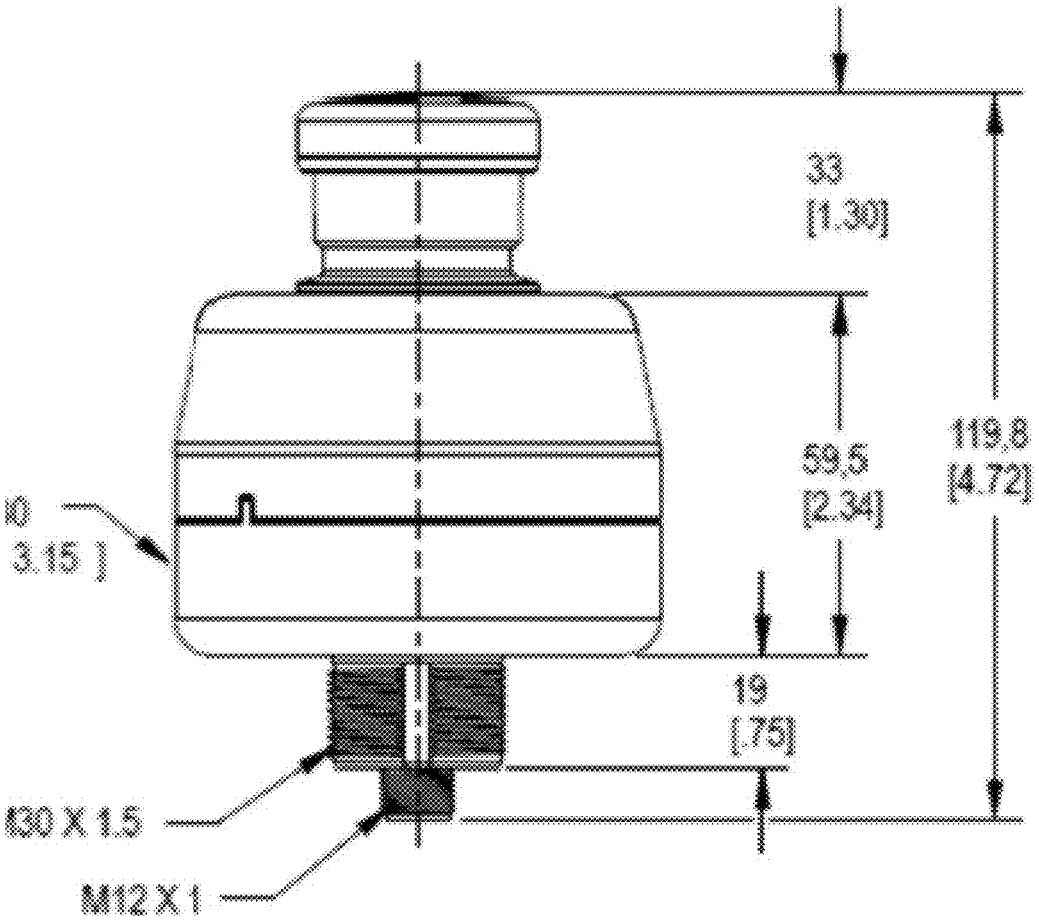
FIG. 6 shows a side view of a switch of the type shown in FIG. 1, with dimensions in one specific example according to this disclosure.
Figure 7:
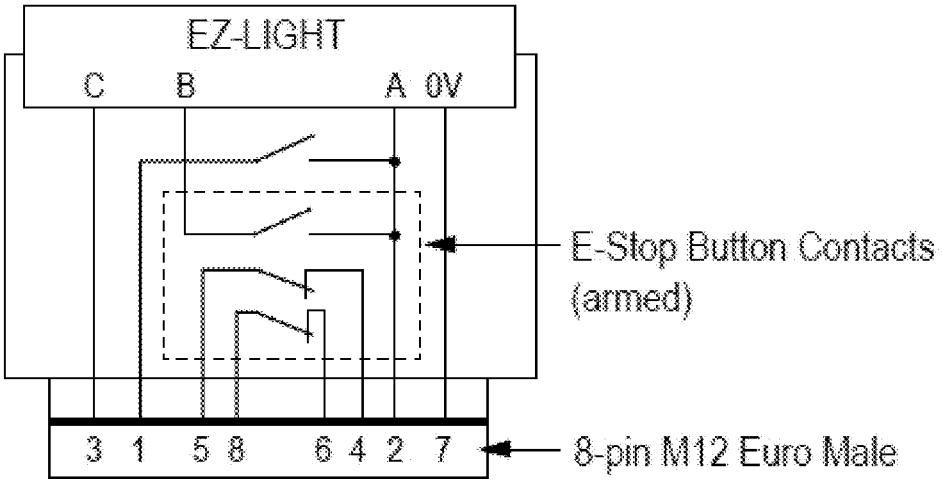
FIG. 7 schematically shows a schematic diagram of the electrical configuration in a switch according to an aspect of the disclosure.
Figure 7:
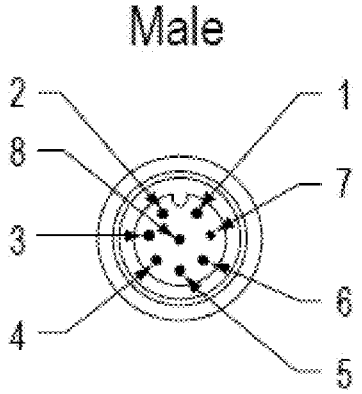
Figure 8:
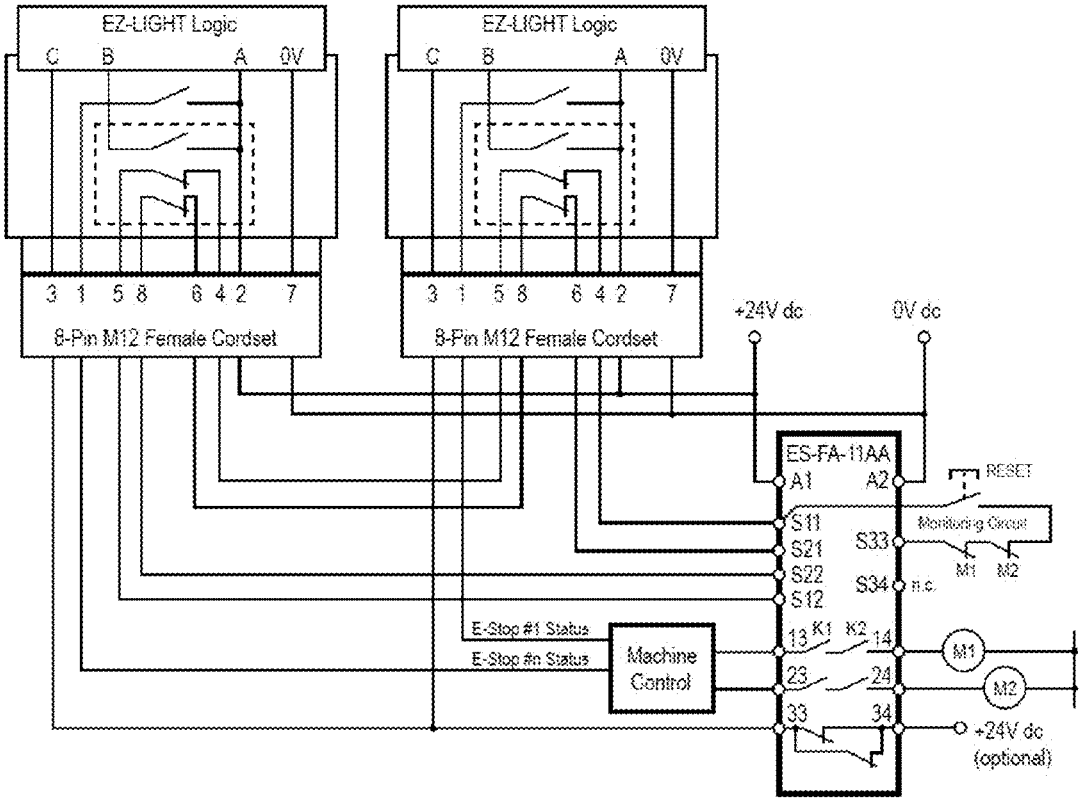
FIG. 8 schematically shows connection of two switches according to an aspect of the disclosure connected to an external device, such as a safety module, according to another aspect of the disclosure.
Figure 9:
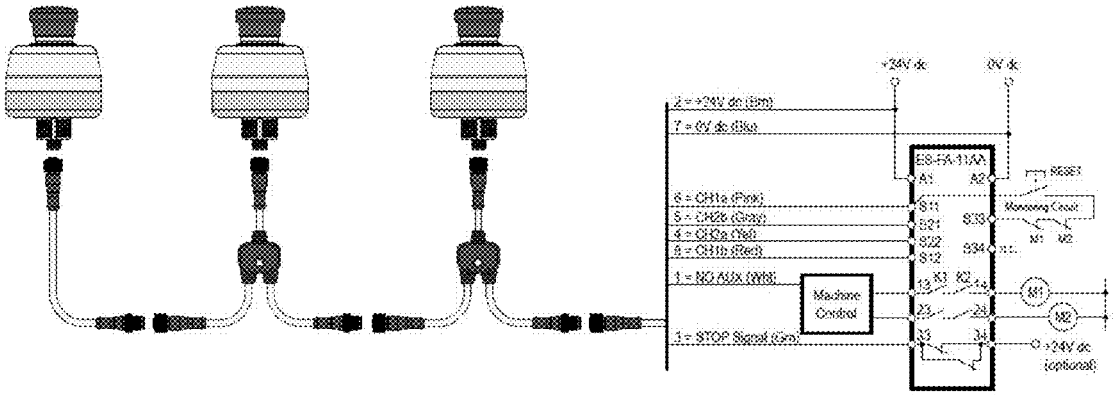
FIG. 9 schematically shows connection of multiple switches according to an aspect of the disclosure connected to an external device, such as a safety module, via modular cables according to another aspect of the disclosure.
Figure 10:
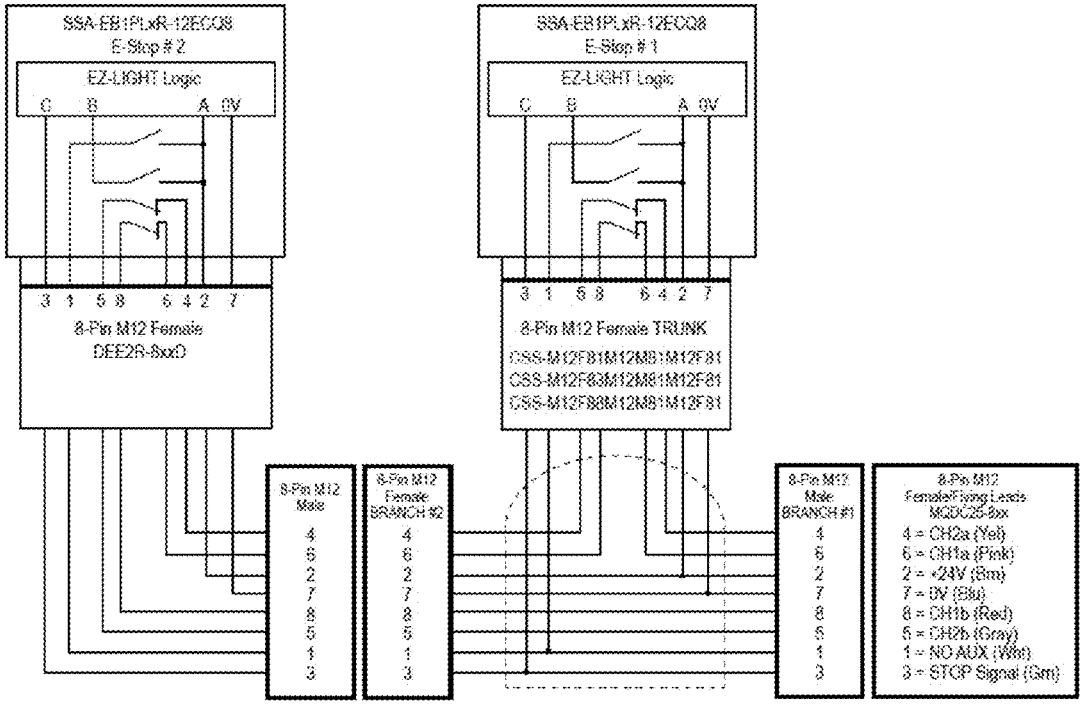
FIG. 10 schematically shows modular cables according an aspect of the disclosure and their connections to switches according to another aspect of the disclosure.
Figure 11:
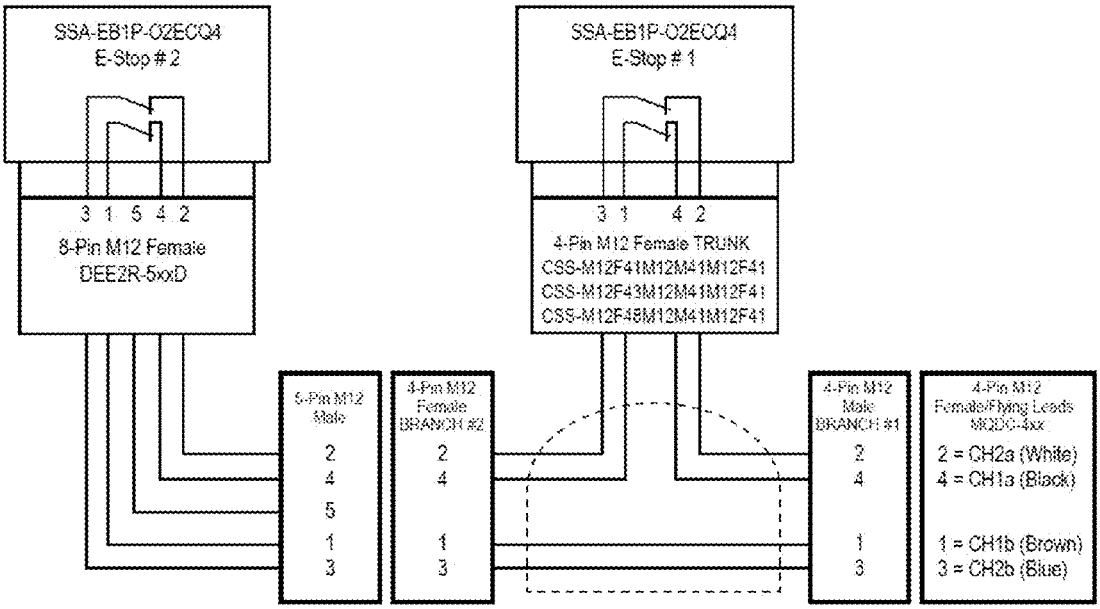
FIG. 11 schematically shows modular cables according an aspect of the disclosure and their connections to switches according to another aspect of the disclosure. In this example, the switches includes no indicator (illuminator) for the state of the pushbutton.

In certain settings, quick, unobstructed access by personnel to emergency stop devices is required on all operator stations and other locations as determined by a risk assessment. Actuating an emergency stop device can remove all energy sources to hazards and overrides all other functions and operations in all modes Under certain regulations, pushbutton-type device for emergency stop devices must be colored RED. The background immediately around pushbutton must be colored YELLOW. Emergency stop device must be continuously operable, clearly identified, clearly visible and readily accessible. The color RED for the emergency stop actuator cannot depend on illumination of the actuator (button).

Many pushbutton-type devices are mounted on control panels/enclosures at operator stations, but a significant number of pushbutton-type devices are also located remotely and require individual enclosures that house the pushbutton-type device and possibly other control and indicating devices. These remote, or stand-alone, enclosures are typically rectangular or square "boxes" that are constructed of metal or plastic.

In many applications, there are several individual pushbutton-type devices that are located in various positions on a machine (see, e.g., ANSI B11.19) or integrated manufacturing system (see, e.g., ANSI B11.20). In situations that require the actuation of the emergency stop function, typically a single pushbutton-type emergency-stop device is depressed. Once the situation is addressed, there may be difficulty in identifying the pushbutton-type device that was actuated (depressed) such that it can be reset allowing the machine or system to be placed in to operation.

Currently, there are two methods to identify an actuated pushbutton-type device other than the physical position of the button. These are a colored ring, typically GREEN, on the shaft of the button, or a RED colored indicator located in the face of the button that will illuminate either when the button is depressed or armed, depending on the installation.

DESCRIPTION OF EXAMPLES

The following examples illustrate various aspects of the present disclosure but are not limiting on the scope of the invention. For example, certain devices described include a 30 mm threaded mounting hub, but such specific dimensions and mounting method are provided for illustrative purpose only and not meant to limit the invention to such specific aspects.

The operating principles of certain exemplary devices of this disclosure are also demonstrated by the use of a testing tool, such as the DBQEZLPTL Demo Box EZ Light Pick To Light Demo Box/Power supply, available from Banner Engineering Corp., Minneapolis, Minn. However, the applications of the switching device of the invention are not limited to use in connection with any such testing tools.

An exemplary 30 mm-mount Emergency Stop pushbutton-type device includes illumination logic intended for quick identification of the status (armed or actuated) of the individual emergency stop button and optional indication of a machine or system stop.

When the button is armed, the enclosure (base) is illuminated yellow for high visibility while complying with the required yellow background requirement of an emergency stop indication. Once the button is actuated (depressed), the enclosure (base) will flash red to indicate the depressed button. This flashing red indication is unique in a standalone pushbutton-type device (i.e. no external signal or logic to create the flash sequence).

The illumination feature of the 30 mm-mount Emergency Stop pushbutton-type device greatly enhances the ability to comply with the requirements to clearly identify emergency stop pushbutton device and for it to be clearly visible. The user also has the option to have the enclosure (base) of an armed button to turn a steady red indication (from yellow) when a STOP condition exists by applying an external signal. This is also unique in a standalone pushbutton-type device.

The disclosure in the Appendix shows examples switching devices and configurations in which several of such switches can be interconnected to form systems of switches according to certain aspects of the present disclosure and the advantages of certain embodiments of the invention. The publication/data sheet numbers (P/N's) and device/component model numbers cited, but not explicitly included, in this disclosure refer to publications/data sheets and devices/component publicly available from Banner Engineering Corp., Minneapolis, Minn.

We claim:

1. A switch, comprising:

a housing comprising a substantially rounded cylindrical wall section substantially surrounding a longitudinal axis;

an electrical circuit enclosed in the housing and comprising a pair of electrical contacts and an illuminating device; and, an actuator disposed substantially along the longitudinal axis adapted to be manually moved along the longitudinal axis relative to the housing to open and close the pair of electrical contacts, the illuminating device being adapted to be set to different states of illumination at least in part depending on an operation of the actuator, and adapted to illuminate at least about a 50% circumferential portion of an exterior portion of the cylindrical wall section.

2. A switch, comprising:

a housing;

an electrical circuit enclosed in the housing and comprising a pair of electrical contacts and an illuminating device; and, an actuator disposed substantially along a longitudinal axis and adapted to be manually moved along the longitudinal axis relative to the housing to open and close the pair of electrical contacts, the illuminating device comprising a substantially rounded cylindrical exterior portion substantially surrounding the longitudinal axis, the illuminating device being adapted to be set to different states of illumination at least in part depending on an operation of the actuator, and adapted to illuminate at least about a 50% circumferential portion of the exterior portion.

3. The switch of claim 1, the illuminating device being adapted to illuminate substantially an entire circumferential portion of an exterior portion of the cylindrical wall section.

4. The switch of claim 2, the illuminating device being adapted to illuminate substantially an entire circumferential portion of the exterior portion.

5. The switch of claim 1, wherein the electrical circuit comprises a plurality of pairs of electrical contacts, and the actuator is adapted to be manually moved to open and close each of the plurality of pairs of electrical contacts.

6. The switch of claim 5, having an armed state, wherein at least a first one of the plurality of pairs of electrical contacts is closed and at least a second one of the plurality of pairs of electrical contacts is open in the armed state, and wherein the actuator is adapted to cause the first one of the plurality of pairs of electrical contacts to open, and the second one of the plurality of pairs of electrical contacts to close, upon a manual movement of the actuator.

7. A system, comprising a plurality of switches, each of which being a switch of claim 5, the plurality of switches being pairwise electrically connected to each other.

8. A system, comprising a plurality of switches, each of which being a switch of claim 6, the plurality of switches being pairwise electrically connected to each other.

9. The system of claim 7, the system further comprising a control unit electrically connected to at least one of the plurality of switches and adapted to detect whether a pair of contacts in the electrical circuit of each of the plurality of switches is open or closed.

10. The system of claim 7, the system further comprising a control unit electrically connected to at least one of the plurality of switches and adapted to control a state of illumination of the exterior portion of each of the plurality of switches.

11. The system, comprising:

arranging the plurality of switches in the system of claim 7 in a plurality of respective locations, detecting a state of illumination of the exterior portion of each of the plurality of switches by machine vision.

12. The switch of claim 1, wherein the actuator is adapted to be moved substantially along the longitudinal axis to open and close the pair of electrical contacts.

13. The switch of claim 2, wherein the actuator is adapted to be moved substantially along the longitudinal axis to open and close the pair of electrical contacts.

14. The switch of claim 1, wherein the pair of electrical contacts are adapted to change a state of operation of an electrical device external to the housing when open or closed by the actuator.

15. The switch of claim 2, wherein the pair of electrical contacts are adapted to change a state of operation of an electrical device external to the housing when open or closed by the actuator.

16. The switch of claim 14, wherein the pair of electrical contacts is adapted to cause the electrical device external to the housing to cease operation.

17. The switch of claim 15, wherein the pair of electrical contacts is adapted to cause the electrical device external to the housing to cease operation.

18. A switch, comprising:

a housing comprising an optical indicator portion having an externally visible annular illumination surface substantially surrounding a longitudinal axis;

a switching module comprising an actuator adapted to be manually actuated to move relative to the housing along the longitudinal axis;

an internal circuit enclosed in the housing; and a connector adapted to connect the switching module to one or more circuits external to the housing, the switching module being adapted to change an operational state of the one or more circuits when the actuator is manually actuated, the switching module being further adapted to cause the internal circuit to set the optical indicator portion to different states of illumination at least in part depending on the operation of the actuator.

19. The switch of claim 18, wherein the actuator of the switching module is positionable in a first, armed position, wherein the switching module permits the one or more circuits external to the housing to continue operation, and a second, actuated position, wherein the switching module causes the one or more circuits external to the housing to cease operation, the internal circuit being adapted to cause the optical indicator portion to emit light of a first color when the actuator is in the armed position and to emit light of a second color when the actuator is in the actuated position.

20. The switch of claim 19, wherein the actuator comprises a push-button actuator disposed above a top portion of the housing, the armed position being further away from the top of the housing than the actuated position, the switch further comprising a mounting base disposed below a bottom portion of the housing and adapted to secure the switch to a support surface, with the housing and push-button actuator positioned above the support surface.

21. The switch of claim 20, wherein the push-button actuator is adapted to be released from the actuated position and positioned in the armed position when twisted about the longitudinal axis.

22. An emergency stop switch, comprising:

a housing comprising an optical indicator portion having an externally visible annular illumination surface substantially surrounding the longitudinal axis;

a switching module comprising a push-button actuator adapted to be manually actuated to move relative to the housing along the longitudinal axis between an armed position and an actuated position, and one or more pairs of electrical contacts enclosed in the housing, the push-button being adapted to close the one or more pairs of contacts when moved to the armed position and to open the one or more pairs of contacts when moved to the actuated position; and a connector mounted on the housing and adapted to connect the one or more pairs of contacts of the switching module to one or more circuits external to the housing, the switching module being adapted to connect electrical power to the one or more external circuits when the actuator is manually moved to the armed position, and to interrupt electrical power to the one or more circuits when the actuator is manually moved to the actuated position, the switching module being further adapted to cause the internal circuit to set the optical indicator portion output light of different colors through the annular illumination surface depending on the longitudinal position of the push-button actuator.

23. The emergency stop switch of claim 22, further comprising a threaded mounting portion protruding from the housing and extending along the longitudinal axis, and adapted to secure the switch to a support.

24. The emergency stop switch of claim 22, wherein the illuminating device is adapted to output light of the second color in a flashing manner indicative of an actuated state of the switch when the actuator is positioned in the actuated position.

* * * * *